US007976034B1

(12) United States Patent
Hong et al.

(10) Patent No.: US 7,976,034 B1
(45) Date of Patent: Jul. 12, 2011

(54) FOLDABLE SKATEBOARD

(76) Inventors: Thomas K. Hong, Toronto (CA); Eunha Hong, Toronto (CA)

( * ) Notice: Subject to any disclaimer, the term of this patent is extended or adjusted under 35 U.S.C. 154(b) by 0 days.

(21) Appl. No.: 12/692,833

(22) Filed: Jan. 25, 2010

(51) Int. Cl.
*A63C 17/02* (2006.01)

(52) U.S. Cl. ..... 280/87.042

(58) Field of Classification Search ..... 280/603, 280/11.16, 11.26, 20, 30, 639, 87.042, 87.05
See application file for complete search history.

(56) References Cited

U.S. PATENT DOCUMENTS 1,317,770 A * 10/1919 Winter ..... 280/603
2,332,404 A * 10/1943 Smith ..... 280/603
2,375,504 A * 5/1945 Svensson ..... 280/603
2,450,538 A * 10/1948 Beaudin ..... 280/603
2,678,829 A * 5/1954 Meland ..... 280/603
2,791,435 A * 5/1957 Meland ..... 280/603
3,583,722 A * 6/1971 Jacobson ..... 280/16
3,689,093 A * 9/1972 Meland et al. ..... 280/603
3,797,838 A * 3/1974 Shurgot et al. ..... 280/603
3,819,198 A * 6/1974 Groves ..... 280/603
4,076,267 A * 2/1978 Lipscomb ..... 280/87.042
4,125,273 A * 11/1978 Rothmayer ..... 280/603
4,155,568 A * 5/1979 Galich ..... 280/603
4,161,326 A * 7/1979 Gaber ..... 280/87.042
4,458,907 A * 7/1984 Meredith ..... 280/87.042
4,530,511 A * 7/1985 Brandt, III ..... 280/603
4,593,926 A * 6/1986 Pergola ..... 280/603
4,600,211 A * 7/1986 Schmidt ..... 280/603
4,632,418 A * 12/1986 Brue Moya et al. ..... 280/603
4,723,789 A * 2/1988 Schmidt ..... 280/603
4,780,929 A * 11/1988 Burns et al. ..... 16/349
5,029,887 A * 7/1991 Grutzner et al. ..... 280/242.1
5,044,044 A * 9/1991 Young et al. ..... 16/323
5,417,444 A * 5/1995 Chen ..... 280/87.042
5,505,474 A * 4/1996 Yeh ..... 280/87.042
5,540,455 A * 7/1996 Chambers ..... 280/87.042
5,769,438 A * 6/1998 Svetlov ..... 280/87.041
6,131,931 A * 10/2000 Globerson et al. ..... 280/87.042
D472,596 S * 4/2003 Schnuckle et al. ..... D21/765
6,616,154 B1 * 9/2003 Neuhold ..... 280/87.05
6,616,170 B1 * 9/2003 Quarti ..... 280/603
6,631,913 B2 * 10/2003 Godfrey ..... 280/87.05
D505,470 S * 5/2005 Hong ..... D21/765
6,926,301 B2 * 8/2005 Emanuele et al. ..... 280/603
7,121,909 B1 * 10/2006 Meyerhoffer ..... 441/74
7,150,461 B2 * 12/2006 Schnuckle et al. ..... 280/87.05

(Continued)

FOREIGN PATENT DOCUMENTS

FR 2613948 A1 * 10/1988

*Primary Examiner* — Hau V Phan
*Assistant Examiner* — Jacob Meyer
(74) *Attorney, Agent, or Firm* — QuickPatents, Inc.; Kevin Prince

(57) ABSTRACT

A foldable skateboard comprising a center deck, a front deck, and a rear deck, is provided. The foldable skateboard also comprises a pair of articulated pivot devices fixed between the center deck and each of the front and rear decks. The side edges of the front deck, center deck, and rear deck being mutually substantially co-aligned when each articulated pivot device is in a first extended position. The top surfaces of the front deck, center deck, and rear deck being mutually substantially coplanar when each articulated pivot device is in the first extended position. The top surfaces of the front and rear decks inverted with respect to the center deck when each articulated pivot device is in a collapsed position.

4 Claims, 3 Drawing Sheets

U.S. PATENT DOCUMENTS

| | | | | |
|---|---|---|---|---|
| D566,708 | S * | 4/2008 | Patton et al. | D14/356 |
| 7,530,582 | B2 * | 5/2009 | Truchsess et al. | 280/87.021 |
| 7,635,137 | B2 * | 12/2009 | Gregory et al. | 280/87.05 |
| D633,584 | S * | 3/2011 | Hong | D21/765 |
| 2002/0089137 | A1 * | 7/2002 | Chang et al. | 280/87.041 |
| 2002/0117824 | A1 * | 8/2002 | Godfrey | 280/87.05 |
| 2003/0127816 | A1 * | 7/2003 | Schnuckle et al. | 280/87.042 |
| 2004/0046363 | A1 * | 3/2004 | Emanuele et al. | 280/603 |
| 2005/0212246 | A1 * | 9/2005 | Hong | 280/87.042 |
| 2007/0029749 | A1 * | 2/2007 | Gregory et al. | 280/87.042 |
| 2007/0029750 | A1 * | 2/2007 | Gregory et al. | 280/87.042 |
| 2007/0035101 | A1 * | 2/2007 | Gregory et al. | 280/87.042 |
| 2007/0176382 | A1 * | 8/2007 | Truchsess et al. | 280/87.05 |
| 2008/0157495 | A1 * | 7/2008 | Choi | 280/87.042 |
| 2008/0174089 | A1 * | 7/2008 | Ekberg | 280/603 |
| 2009/0256332 | A1 * | 10/2009 | Ekberg | 280/603 |
| 2011/0042913 | A1 * | 2/2011 | Landau | 280/87.042 |

* cited by examiner

FOLDABLE SKATEBOARD

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to skateboards, and more particularly to a foldable skateboard.

DISCUSSION OF RELATED ART

A growing number of people use skateboards as a means for commuting, for example, between home, work, school, and the like. A conventional skateboard typically consists of a rigid deck with front and rear truck assemblies attached thereto. A user stands upon the deck, and may control the direction in which the skateboard is traveling by shifting weight to certain places about the board. Conventional skateboards are also by their nature bulky and difficult to carry when not in use. The bulkiness can lead to problems, for example, at households where skateboards are left out in the open. Someone or something may accidentally knock the skateboard into household objects or someone may slip and fall because of the skateboard. This can often lead to injury to a person and damage to property.

Various examples of collapsible or foldable skateboards are described, for example, in U.S. Pat. No. 7,150,461 B2 to Schnuckle et al., on Dec. 19, 2006. Schnuckle describes a skateboard comprising an articulated structure having a foot platform, at least one forward and one rearward ground engaging wheel. The skateboard comprises an articulated foldable structure, a forward ground engaging wheel operably connected to the articulated structure, a rearward ground engaging wheel operably connected to the articulated structure, and a tensioning mechanism including a cable attached at one end to the forward portion and attached at another end to the rearward portion for placing the articulated structure under tension while in a first skating position. The forward portion and the rearward portion are each positionable from the first skating position to a second folded position with the cable becoming slack and wherein the forward portion and the rearward portion each nest within the middle portion while in the second folded position. However, the foldable skateboard of Schnuckle does not resemble a traditional skateboard in terms of materials used, appearance, weight, or performance.

U.S. Pat. No. 7,063,341 B2 to Tsai, on Jun. 20, 2006, describes a collapsible skateboard that includes an upright handle having a lower portion on which is fixedly mounted a bracket. The skateboard also includes a connector having a curved slot having a lower end formed with a horizontal recess, an upper end formed with a vertical recess, and a circular hole under the vertical recess. The skateboard also includes an adjust pin inserted into the vertical recess of the connector and the elongated hole of the bracket, a pivot pin fitted through the circular hole of the connector and the circular hole of the bracket, a spring having an upper end connected to the adjust pin and a lower end to the pivot pin, and a platform on which is fixedly mounted the connector, whereby the skateboard may be folded as desired. However, the collapsible skateboard of Tsai does not resemble a traditional skateboard in terms of appearance, weight, and performance. Furthermore, the skateboard is more bulky than a traditional skateboard because the skateboard of Tsai also includes an upright handle.

U.S. Pat. No. 6,270,097 B1 to Lin, on Aug. 7, 2001, describes a similar foldable skateboard device as the skateboard described by Tsai. Lin describes a foldable skateboard device that includes a board, a holding seat disposed on a front portion of the board, a down tube inserted in the holding seat and connected to an upright handle, a front tube connected to the down tube, a front wheel disposed on a bottom of the front tube, and a rear wheel disposed on a rear end of the board. The down tube has an annular flange. The holding seat has a hollow connection portion receiving a lower end of the down tube, a recess, and an upper confining portion. A pivot pin fastens the hollow connection portion of the holding seat and the lower end of the down tube together. A sleeve is disposed on a middle portion of the down tube. An elastic element encloses the down tube. However, the collapsible skateboard of Lin does not resemble a traditional skateboard in terms of appearance, weight, and performance. Furthermore, the skateboard is more bulky than a traditional skateboard because the skateboard of Lin also includes a down tube connected to an upright handle.

U.S. Pat. No. 6,131,931 to Globerson et al., on Oct. 17, 2000, describes a conventionally shaped skateboard that is divided into three sections, one section measures at about half the length of the skateboard, a middle section measures at approximately the height of the truck and wheel assembly, and a third section constitutes the remaining length of the skateboard. The three sections are hinged together to form a folding skateboard such that when the skateboard is folded, the trucks and wheels of the skateboard are adjacent each other in the interior and in the form of a J-shaped configuration. The sections are locked in an extended, aligned orientation to form a usable skateboard in three embodiments by clips which fit onto the side edges of the skateboard deck and in a fourth embodiment by rods which fit into and slide within cylindrical grooves formed on the bottom of the skateboard deck. The clips and rods are of such a length that they are long enough to span the middle section and a sufficient portion of the two sections to lock the skateboard open but short enough to fit on the longest section without protruding beyond its extremities, when the skateboard is folded. However, the skateboard described by Globerson does not rest flatly upon its longest section, when collapsed. Instead, the skateboard must rest unevenly on the ground. The skateboard is not very compact in nature. Furthermore, extra accessories are needed to store or transport the skateboard, for example, the tie strap and the shoulder strap.

U.S. Pat. No. 5,505,474 to Yeh, on Apr. 9, 1996, describes a folding skateboard including a plurality of frame bars pivotably connected in series by links, two couplings turned about a respective pivot at two opposite ends of the series of frame bars, two wheel assemblies respectively fastened to the couplings to support the frame bars on the ground, and two foot plates respectively fastened to the couplings above the wheel assemblies for the user to ride by legs. However, the folding skateboard of Yeh does not resemble a traditional skateboard in terms of materials used, appearance, weight, or performance.

Therefore, there is a need for a skateboard that resembles a traditional skateboard in terms of materials used, appearance, weight, and performance, that is capable of being compactly collapsed to be stored in small spaces, for example, under car seats, under desks, in backpacks, and the like. The present invention accomplishes these objectives.

SUMMARY OF THE INVENTION

The present device is a foldable skateboard comprising a center deck, a front deck, and a rear deck. The center deck has two opposing side edges, opposing top and bottom surfaces, and front and rear ends. The front deck has two opposing side edges, opposing top and bottom surfaces, and a rear end. The bottom surface of the front deck includes a front truck attachment means. The rear deck has two opposing side edges, opposing top and bottom surfaces, and a front end. The bottom surface of the rear deck includes a rear truck attachment means. The foldable skateboard also comprises a pair of articulated pivot means fixed between the center deck and each of the front and rear decks. The side edges of the front deck, center deck, and rear deck being mutually substantially co-aligned when each articulated pivot means is in a first extended position. The top surfaces of the front deck, center deck, and rear deck being mutually substantially coplanar when each articulated pivot means is in the first extended position. The top surfaces of the front and rear decks inverted with respect to the center deck when each articulated pivot means is in a collapsed position.

Each of the articulated pivot means may include two pivot pins and a pivot bar. One of the pivot pins may be fixed to the center deck and the other pivot pin may be fixed to either the front or rear deck. The pivot bar may rotationally capture each pivot pin.

The foldable skateboard may further include a plurality of strengthening pins extending is between the center deck and each of the front and rear decks, each strengthening pin may be captured by one of the decks and may be slidably received in its corresponding opposing deck. Each of the front and rear decks may be longitudinally mutually separated thereby being free from the center deck and thereby able to pivot into the folded or collapsed position. At least one of the strengthening pins and one of the decks may include a latch and lock means, such that when in a locked position the center deck cannot be longitudinally separated from its adjacent deck, and such that when in an unlocked position the center deck may be longitudinally separated from its adjacent deck.

The foldable skateboard may further include a pivot mechanism fixed between the center deck and each of the front and rear decks. Each pivot mechanism may include a pair of articulated pivot means, a center deck mount, and an outside deck mount. With two pivot mechanisms fixed to each of the front and rear ends of the center deck at the center deck mounts thereof, the center deck mounts may be flush with the side edges and top and bottom surfaces of the center deck, and with the outside deck mount of each pivot mechanism fixed to either the rear end of the front deck or the front end of the rear deck. Also, each outside deck mount may be flush with the side edges and top and bottom surfaces of the front and rear decks. When each lock means is in a locked position, the center deck cannot be longitudinally separated from its adjacent deck, and when each lock means is in an unlocked position, the center deck may be longitudinally separated from its adjacent deck. Once unlocked, the adjacent deck is free to pivot around the articulated pivot means between a collapsed position and an extended position.

The present invention is a skateboard that resembles a traditional skateboard in terms of materials used, appearance, weight, and performance, that is capable of being compactly collapsed to be stored in small spaces, for example, under car seats, under desks, in backpacks, and the like. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

The foldable skateboard is divided into three sections, a front deck, a center deck, and a rear deck section. The front deck and the rear deck are disposed on opposing sides of the center deck. The front deck and the rear deck sections may each be secured to the center deck, for example, by a spring loaded latch. To fold the foldable skateboard a user may depress an actuator to cause spring plates to compress springs, unlocking a latch located on the underside of the deck to unlock and then separate the front deck and the rear deck from the center deck, prior to folding the skateboard. From its compacted state, the user can restore the skateboard to its full length by unfolding the front deck and the rear deck until they are horizontally adjacent to the center deck. The front deck may be slid towards the center deck until the front deck self-locks to the center deck. The rear deck may be slid towards the center deck until the rear deck self-locks to the center deck.

Figure 1:
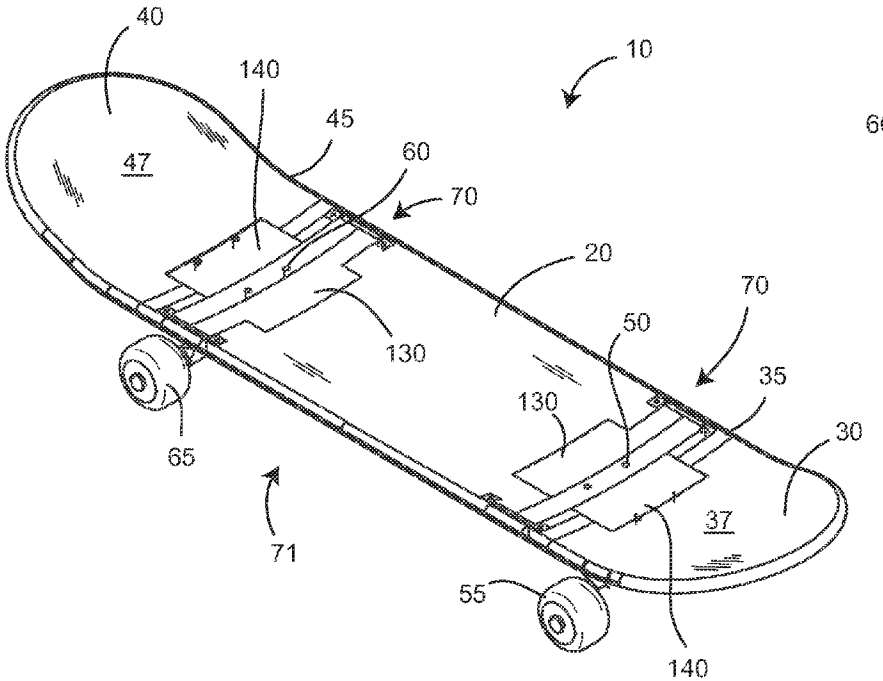
FIG. 1 is a diagram illustrating a foldable skateboard in an extended state, according to example embodiments.

FIG. 1 illustrates a foldable skateboard in an extended state, according to various example embodiments. Referring to FIG. 1, foldable skateboard 10 comprises a center deck 20, a front deck 30, and a rear deck 40. Positioned between the front deck 30 and the center deck 20 is a pair of articulated pivot means 70. Also positioned between the center deck 20 and the rear deck 40 is a pair of articulated pivot means 70.

Figure 4:
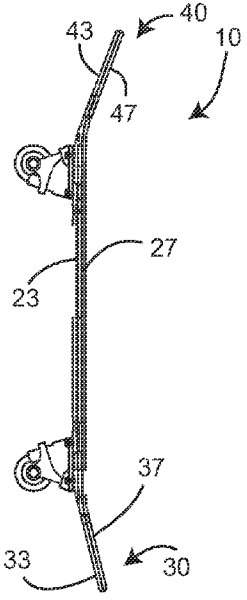
FIG. 4 is a diagram illustrating a front perspective of the foldable skateboard illustrated in FIG. 1, according to example embodiments.
Figure 2:
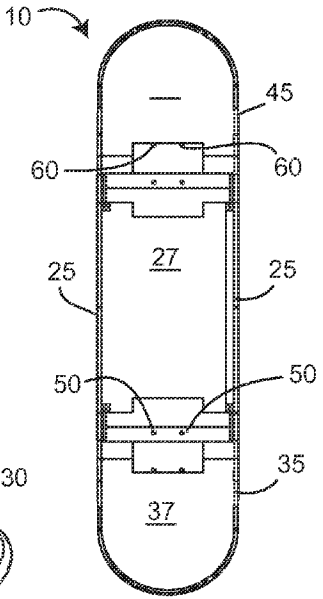
FIG. 2 is a diagram illustrating a top perspective of the foldable skateboard illustrated in FIG. 1, according to example embodiments.
Figure 3:
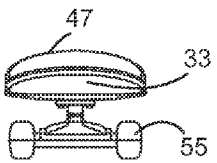
FIG. 3 is a diagram illustrating a side perspective of the foldable skateboard illustrated in FIG. 1, according to example embodiments.

FIG. 2 illustrates a top perspective of foldable skateboard 10, FIG. 3 illustrates a front perspective of foldable skateboard 10, and FIG. 4 illustrates a side perspective of foldable skateboard 10, according to example embodiments.

Figure 5:
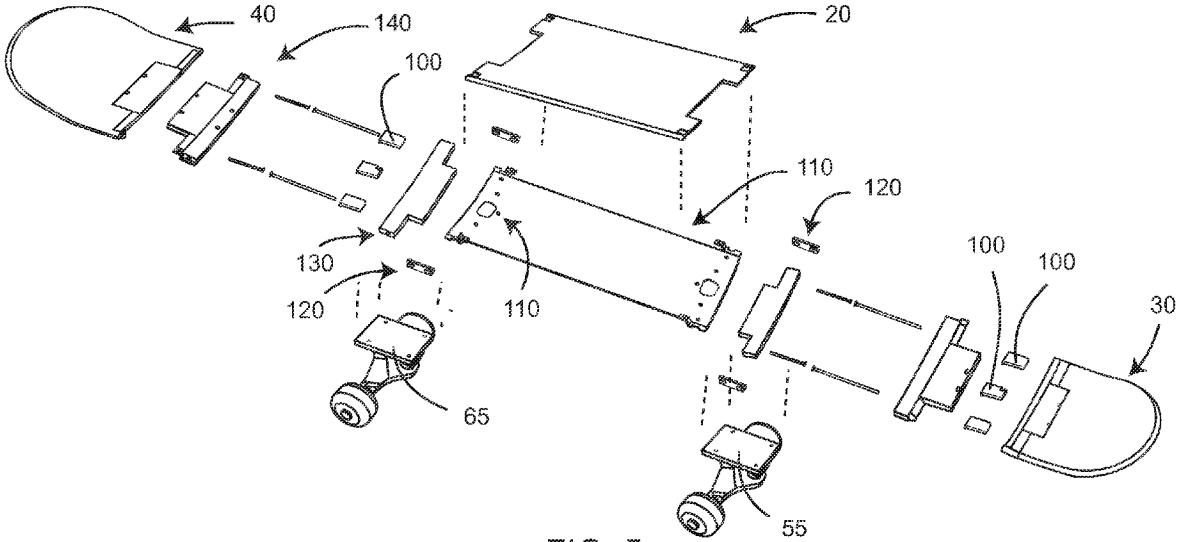
FIG. 5 is a diagram illustrating an exploded view of a foldable skateboard, according to example embodiments.

Referring to FIGS. 1-5, the center deck 20 comprises two opposing side edges 25, as shown in FIG. 2. The two opposing side edges 25 being disposed on opposite sides of the center deck 25, with respect to each other. The center deck comprises a top surface 27, as shown in FIG. 2, and a bottom surface 23, as shown in FIG. 4. The top surface 27 being disposed on an opposing surface of center section 20, with respect to bottom surface 23. The center deck 20 also comprises a front end 28 and a rear end 22 (FIG. 5).

The front end 28 is disposed on an opposing end of center section 20, with respect to rear end 22.

The front deck 30 comprises two opposing side edges 35, as shown in FIG. 2. The two opposing side edges 35 being disposed on opposite sides of the front deck 30, with respect to each other. The front deck 30 comprises a top surface 37, as shown in FIG. 1, and a bottom surface 33, as shown in FIG. 4. Front deck 30 also comprises a rear end 32 disposed at the end adjacent the front end 28 of the center deck 20 (FIG. 5). Furthermore, front deck 30 comprises a front truck attachment means 50 disposed on bottom surface 33, such as a block fixed to the front deck 30 and adapted for receiving front trucks 55 fastened thereto with screws (not shown), or other mechanical fasteners, or the like.

The rear deck 40 comprises two opposing side edges 45, as shown in FIG. 2. The two opposing side edges 45 being disposed on opposite sides of the rear deck 40, with respect to each other. The rear deck 40 comprises a top surface 47, as shown in FIG. 1, and a bottom surface 43, as shown in FIG. 4. Rear deck 40 also comprises a front end 48 disposed at the end adjacent the rear end 22 of the center deck 20 (FIG. 5). Furthermore, rear deck 40 comprises a rear truck attachment means 60 disposed on bottom surface 43, such as a block fixed to the rear deck 40 and adapted for receiving rear trucks 65 fastened thereto with screws (not shown), or other mechanical fasteners, or the like.

Figure 6:
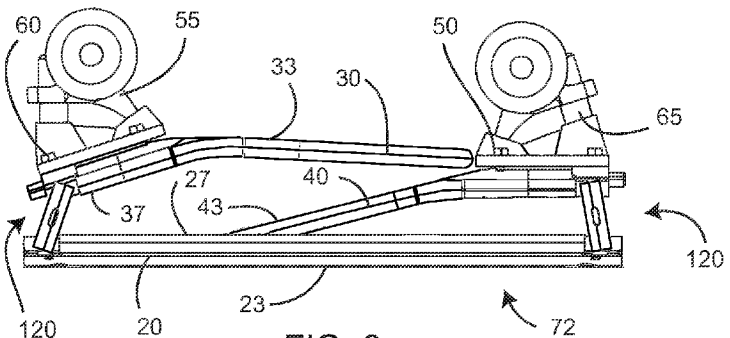
FIG. 6 is a diagram illustrating a foldable skateboard in a folded state, according to example embodiments.

The foldable skateboard 10 also comprises a pair of articulated pivot means 70 fixed between the center deck 20 and each of the front deck 30 and the rear deck 40. The side edges 35 of the front deck 30, the side edges 25 of the center deck 20, and the side edges 45 of the rear deck 40 being mutually substantially co-aligned when each articulated pivot means 70 is in a first extended position 71, as illustrated in FIG. 1. The top surface 37 of the front deck 30, the top surface 27 of the center deck 20, and the top surface 47 of the rear deck 40 being mutually substantially coplanar when each articulated pivot means 70 is in the first extended position 71. The top surface 37 of the front deck 30 and the top surface 47 of the rear deck 40 being inverted with respect to the center deck 20 when each articulated pivot means 70 is in a collapsed position 72, as shown in FIG. 6.

Figure 9:
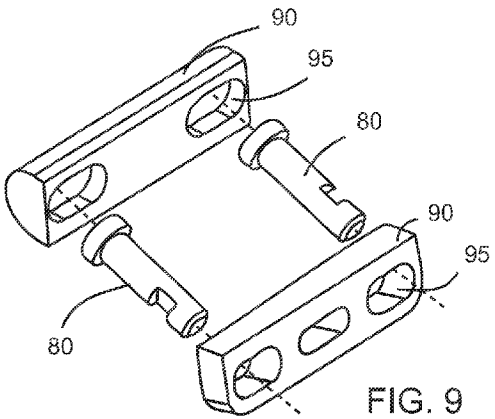
FIG. 9 is a diagram of an articulated pivot means of the foldable skateboard, according to example embodiments.

FIG. 9 illustrates an articulated pivot means 70, according to example embodiments. Referring to FIG. 9, each of the articulated pivot means 70 may include two pivot pins 80 and a pivot bar 90. One of the pivot pins 80 may be fixed the to the center deck 20 and the other pivot pin 80 may be fixed to either the front deck 30 or rear deck 40. The pivot bar 90 may rotationally capture each pivot pin 80.

Figure 8:
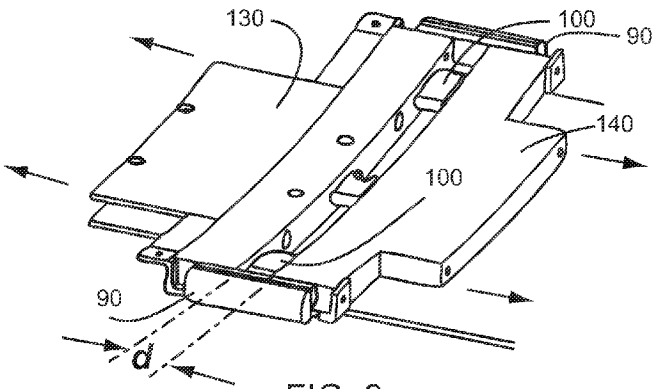
FIG. 8 is a diagram of a pivot mechanism in an unlocked position, according to example embodiments.
Figure 7:
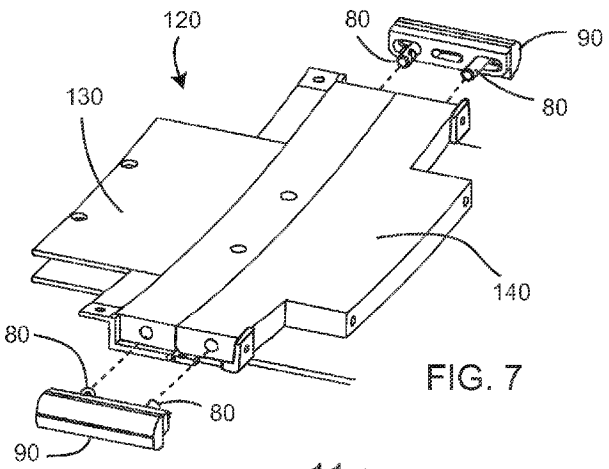
FIG. 7 is diagram of a pivot mechanism in a locked position, according to example embodiments.

FIG. 7 illustrates a pivot mechanism in a locked position, according to example embodiments. FIG. 8 illustrates a pivot mechanism in an unlocked position. Referring to FIG. 7, a pivot bar 90 and two pivot pins 80 may be used on each side of the skateboard. As illustrated by the dotted lines, a first pivot pin 80 may be fixed to an outside deck mount 140 of a pivot mechanism 120. A second pivot pin 80 may be fixed to a center deck mount 130 of pivot mechanism 120. The center deck mount 130 may be attached to a center deck 20. The outside deck mount 140 may be attached to a front deck 30 or a rear deck 40. Thus, pivot mechanism 120 may be fixed between the center deck and each of the front deck 30 and the rear deck 40.

FIG. 5 illustrates an exploded view of a foldable skateboard, according to example embodiments. Referring to FIGS. 5 and 9, the foldable skateboard 10 may include one or more strengthening pins 100 extending between the center deck 20 and each of the front deck 30 and the rear deck 40. Each strengthening pin 100 may be captured by one of the center deck 20, the front deck 30, and the rear deck 40, and be slidably received in its corresponding opposing deck. Each pivot bar 90 may include at least one elongated aperture 95 therein for slidably and rotationally capturing the pivot pins 80, as shown in FIG. 9.

Referring to FIG. 8, each of the front deck 30 and the rear deck 40 may be longitudinally is mutually separated a distance d to free one side of each of the strengthening pins 100 from one of the center deck 20, the front deck 30, and the rear deck 40. The elongated apertures 95 that may be in each pivot bar, allow the decks to be separated, for example, by a predetermined distance d. Each of the front deck 30 and the rear deck 40 may thereby be free from the center deck 20 and thereby be able to pivot into the collapsed or folded position 72, as illustrated in FIG. 6.

Figure 11A:
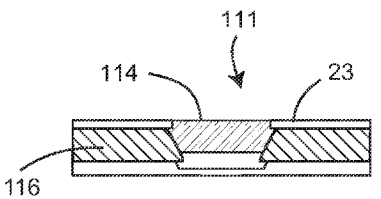
FIG. 11A is a cross-sectional diagram of the latch and lock means of FIG. 10, taken generally along lines 11-11 of FIG. 10, illustrating the latch and lock means in a latched and locked position.
Figure 11B:
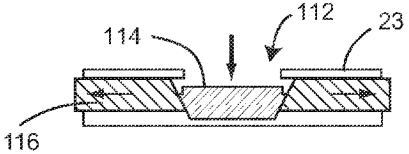
FIG. 11B is a cross-sectional diagram of the latch and lock means of FIG. 10, taken is generally along lines 11-11 of FIG. 10, illustrating the latch and lock means in an unlocked position.
Figure 10:
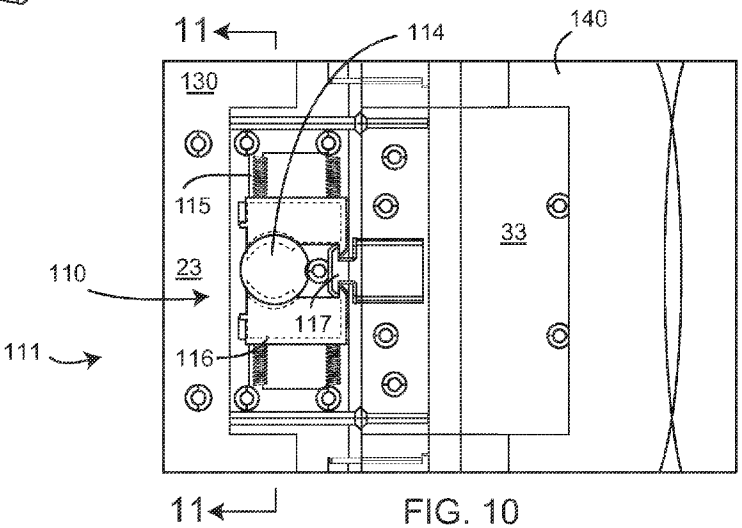
FIG. 10 is a diagram of a latched latch and lock means of the foldable skateboard, according to example embodiments.

FIGS. 10 and 11A illustrates a locked latch and lock means 110 of the foldable skateboard, according to example embodiments. FIG. 11B illustrates an unlocked latch and lock means 110 of the foldable skateboard, according to example embodiments. Referring to FIGS. 10, 11A, and 11B, at least one of the strengthening pins 100 and one of the decks (20, 30, and 40) may include a latch and lock means 110, such that when in a locked position 111 the center deck 20 cannot be longitudinally separated from its adjacent deck (30 and 40), and such that when in an unlocked position 112, the center deck 20 may be longitudinally separated from its adjacent deck (30 and 40).

Referring to FIGS. 10, 11A, and 11B, when a user desires to unlock latch and lock means 110, a user may depress actuator 114 to cause spring plates 116 to compress springs 115, and unlock latch 117. After the latch and lock means 110 is unlocked, as shown in FIG. 11B, center deck 20 and front deck 30 may be separated from each other, at center deck mount 130 and outside deck mount 140. Upon release of the latch and lock means 110, the spring 115 may decompress back to its original position, forcing the spring plates 116 to move towards each other to push actuator 114 back up to towards the bottom surface 23. In some embodiments, the latch and lock means 110 may be biased towards the locked position 111. When a user desires to unfold the skateboard, the latch and lock means 110, may automatically lock into place when the front deck 30 is brought mutually substantially coplanar with center deck 20. In some embodiments, spring 115 may be biased towards the locked position 111. For example, the latch and lock means 110 may automatically lock into place when the rear deck 40 is brought mutually substantially coplanar with center deck 20. In some embodiments, as shown in FIG. 10, the hook shape of the latch 117 may allow the latch and lock means to be biased towards the locked position 111. For example, when center deck 20 and front deck 30 are pushed towards each other, latch and lock means 110 may lock automatically without any aid from a user.

Referring to FIG. 7, a pivot mechanism 120 may be fixed between the center deck 20 and the front deck 30. A pivot mechanism 120 may be fixed between center deck 20 and rear deck 40. Each pivot mechanism 120 may include a pair of articulated pivot means 70, a center deck mount 130, and an outside deck mount 140. Each articulated pivot means 70 may include a pivot bar 90 and two pivot pins 80 fixed to the outside deck mount 140 and the center deck mount 130. The pivot bar 90 may rotationally capture each pivot pin 80, as shown in FIG. 9.

Referring to FIG. 8, each strengthening pin 100 extending between the center deck mount 130 and outside deck mount 140 may be captured by one of the deck mounts and slidably received in the corresponding opposing deck mount. Each pivot bar 90 may further include at least one elongated aperture 95 for slidably and rotationally capturing one of the pivot pins 80.

As shown in FIG. 8, when latch and lock means 110 is unlocked to position 112, center deck mount 130 and outside deck mount 140 may slide apart from each other. Also, strengthening pins 100 may slide apart from the deck that they are not captured by. The arrows indicate a direction of movement for the center deck mount 130 and the outside deck mount 140. Once center deck mount 130 and outside deck mount 140 are a large enough distance apart, outside deck mount 140 may be pivotally folded over center deck mount 130, as shown in FIG. 6.

Referring to FIG. 1 and FIG. 6, a pivot mechanism 120 may be fixed to each of the front end 28 and the rear end 22 of the center deck 20 at the center deck mounts 130. Each center deck mount 130 may be flush with the side edges 25, top surface 27, and bottom surface 23 of the center deck 20. Furthermore, each center deck mount 130 may be flush with the outside deck mount 140 of each pivot mechanism 120 fixed to either the rear end 32 of the front deck 30 or the front end 48 of the rear deck 40. Each outside deck may be flush with the side edges and the top and bottom surfaces of the front deck 30 and the rear deck 40. For example, outside deck mount 140 may be flush with the side edges 35, the top surface 37, and the bottom surface 33 of the front deck 30. Also, the outside deck mount 140 may be flush with the side edges 45, the top surface 47, and the bottom surface 43 of the rear deck 40.

When each lock and latch means 110 is in a locked position 111, the center deck 20 cannot be longitudinally separated from its adjacent deck (30 and 40), and when each latch and lock means 110 is in an unlocked position 112, the center deck 20 may be longitudinally separated from its adjacent deck (30 and 40. After separation, the adjacent decks (30 and 40) are free to pivot around the articulated pivot means 70 between a folded position 72 and an extended position 71.

FIG. 6 illustrates the foldable skateboard 10 in a folded state. Referring to FIG. 6, when foldable skateboard 10 is in folded position 72, front deck 30 and rear deck 40 may be rotated such that the top surface 37 of the front deck 30 and the top surface 47 of the rear deck 40, are facing, or substantially facing the top surface 27 of the center deck 20. As shown in FIG. 6, front truck 55 may attach to front truck attachment means 50, and rear truck 65 may attach to rear truck attachment means 60. In the example illustrated in FIG. 6, the front deck 30 is folded on top of the rear deck 40. However, the opposite may be performed as well. When a user desires to unfold the skateboard, the latch and lock means 110, may automatically lock into place when the front deck 30 is brought mutually substantially coplanar with center deck 20. Also, the latch and lock means 110 may automatically lock into place when the rear deck 40 is brought mutually substantially coplanar with center deck 20, as shown in FIG. 1.

Thus, there is provided a skateboard 10 that resembles a traditional skateboard in terms of materials used, appearance, weight, and performance, that is capable of being compactly collapsed to be stored in small spaces, for example, under car seats, under desks, in backpacks, and the like. The skateboard can be of traditional weight and size of a skateboard, while at the same time being foldable so as to be stored safely out of the open.

While a particular form of the invention has been illustrated and described, it will be apparent that various modifications can be made without departing from the spirit and scope of the invention. For example, the skateboard may be comprised of various desired materials, for example, the components may be metal, plastic, wooden, composite, rubber or other desired material. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be is exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with is which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A foldable skateboard comprising:

a center deck having two opposing side edges, opposing top and bottom surfaces, and front and rear ends;

a front deck having two opposing side edges, opposing top and bottom surfaces, and a rear end, the bottom surface of the front deck including a front truck attachment means;

a rear deck having two opposing side edges, opposing top and bottom surfaces, and a front end, the bottom surface of the rear deck including a rear truck attachment means;

a pair of articulated pivot means fixed between the center deck and each of the front and rear decks, the side edges of the front deck, center deck, and rear deck being mutually substantially co-aligned when each articulated pivot means is in a first extended position, the top surfaces of the front deck, center deck, and rear deck being mutually substantially coplanar when each articulated pivot means is in the first extended position, the top surfaces of the front and rear decks inverted with respect to the center deck when each articulated pivot means is in a collapsed position;

each of the articulated pivot means including two pivot pins and a pivot bar, one of the pivot pins fixed to the center deck and the other pivot pin fixed to either the front or rear deck, the pivot bar rotationally capturing each pivot pin; and a plurality of strengthening pins extending between the center deck and each of the front and rear decks, each strengthening pin being captured by one of the decks and slidably received in its corresponding opposing deck, each pivot bar further including at least one elongated aperture therein for slidably and rotationally capturing the one of the pivot pins;

whereby each of the front and rear decks may be longitudinally mutually separated to free one side of each of the strengthening pins from one of the decks, the elongated apertures in each pivot bar allowing the decks to be separated by only a predetermined distance, each of the front and rear decks thereby being free from the center deck and thereby able to pivot into the collapsed position.

2. The foldable skateboard of claim 1 wherein at least one of the strengthening pins and one of the decks includes a latch and lock means, such that when in a locked position the center deck cannot be longitudinally separated from its adjacent deck, and such that when in an unlocked position the center deck may be longitudinally separated from its adjacent deck.

3. The foldable skateboard of claim 2 wherein the lock means is biased towards the locked position.

4. A foldable skateboard comprising:

a center deck having two opposing side edges, opposing top and bottom surfaces, and front and rear ends;

a front deck having two opposing side edges, opposing top and bottom surfaces, and a rear end, the bottom surface of the front deck including a front truck attachment means;

a rear deck having two opposing side edges, opposing top and bottom surfaces, and a front end, the bottom surface of the rear deck including a rear truck attachment means; and a pair of articulated pivot means fixed between the center deck and each of the front and rear decks, the side edges of the front deck, center deck, and rear deck being mutually substantially co-aligned when each articulated pivot means is in a first extended position, the top surfaces of the front deck, center deck, and rear deck being mutually substantially coplanar when each articulated pivot means is in the first extended position, the top surfaces of the front and rear decks inverted with respect to the center deck when each articulated pivot means is in a collapsed position; and a pivot mechanism fixed between the center deck and each of the front and rear decks, each pivot mechanism including each articulated pivot means, a center deck mount, and an outside deck mount, each of the articulated pivot means includes two pivot pins and a pivot bar, one of the pivot pins fixed to the center deck mount and the other pivot pin fixed to the outside deck mount, the pivot bar rotationally capturing each pivot pin, a plurality of strengthening pins extending between the center deck mount and the outside deck mount, each strengthening pin being captured by one of the deck mounts and slidably received in its corresponding opposing deck mount, each pivot bar further including at least one elongated aperture therein for slidably and rotationally capturing the one of the pivot pins, at least one of the strengthening pins and the center deck mount including a latch and lock means, such that when in a locked position the center deck mount cannot be longitudinally separated from the outside deck mount, and such that when in an unlocked position the center deck mount may be longitudinally separated from the outside deck mount, the lock means biased towards the locked position;

whereby with two pivot mechanisms fixed to each of the front and rear ends of the center deck at the center deck mounts thereof, the center deck mounts each being flush with the side edges and top and bottom surfaces of the center deck, and with the outside deck mount of each pivot mechanism fixed to either the rear end of the front deck or the front end of the rear deck, each outside deck mount being flush with the side edges and top and bottom surfaces of the front and rear decks, and when each lock means is in a locked position, the center deck cannot be longitudinally separated from its adjacent deck, and when each lock means is in an unlocked position, the center deck may be longitudinally separated from its adjacent deck, the adjacent deck then being free to pivot around the articulated pivot means between a collapsed position and an extended position.

* * * * *